US007565874B2

(12) United States Patent
Kawaguchi et al.

(10) Patent No.: US 7,565,874 B2
(45) Date of Patent: Jul. 28, 2009

(54) CYLINDRICAL FRAME UNIT

(75) Inventors: Yasuhiko Kawaguchi, Nagoya (JP); Tomoyasu Niizeki, Inazawa (JP); Yasukazu Noguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 12/078,629

(22) Filed: Apr. 2, 2008

(65) Prior Publication Data

US 2008/0250994 A1 Oct. 16, 2008

(30) Foreign Application Priority Data

Apr. 10, 2007 (JP) ..... 2007-102397
Mar. 4, 2008 (JP) ..... 2008-053507

(51) Int. Cl.
*D05B 39/00* (2006.01)
*D05C 9/04* (2006.01)

(52) U.S. Cl. ..... 112/470.14; 112/103

(58) Field of Classification Search ..... 112/103, 112/470.14, 470.09, 470.06, 470.18, 475.11, 112/475.18

See application file for complete search history.

(56) References Cited

U.S. PATENT DOCUMENTS 5,701,831 A * 12/1997 Morita ..... 112/103
5,937,774 A * 8/1999 Hayashi ..... 112/103
6,453,833 B1 * 9/2002 Ozeki ..... 112/103
6,532,882 B1 3/2003 Tajima et al.
7,080,602 B2 * 7/2006 Kawaguchi et al. ..... 112/103

FOREIGN PATENT DOCUMENTS

| | | |
|---|---|---|
| JP | A-2000-256955 | 9/2000 |
| JP | A-2000-317167 | 11/2000 |
| JP | A-2000-355867 | 12/2000 |
| JP | A-2005-073813 | 3/2005 |
| JP | A-2005-076137 | 3/2005 |

* cited by examiner

*Primary Examiner*—Ismael Izaguirre
(74) *Attorney, Agent, or Firm*—Oliff & Berridge, PLC

(57) ABSTRACT

A cylindrical frame unit of an embroidery sewing machine including a cylinder bed, an X-directional drive mechanism and a Y-directional drive mechanism, the cylindrical frame unit including a body frame connected to the Y-directional drive mechanism and driven parallel to the cylinder bed; a cylindrical rotary frame pivoted on the body frame and having an inner cylindrical surface; a cylinder frame holding a workpiece and being attachably/detachably attached to the rotary frame; a rotary mechanism connected to the X-directional drive mechanism and driven perpendicularly relative to the body frame to rotate the rotary frame and the cylinder frame attached thereto; a position regulating element that slidably contacts an upper surface of the cylinder bed and an upper inner cylindrical surface of the rotary frame; and a mount element securing the position regulating element to the body frame to allow adjustment in vertical positioning relative to the body frame.

4 Claims, 9 Drawing Sheets

CYLINDRICAL FRAME UNIT

CROSS-REFERENCE TO RELATED APPLICATION

This application is based upon and claims the benefit of priority from the prior Japanese Patent Applications 2007-102397, filed on, Apr. 10, 2007, and 2008-053507, filed on, Mar. 4, 2008, the entire contents of which are incorporated herein by reference.

FIELD

The present disclosure relates to a cylindrical frame unit mounted on an embroidery sewing machine, and more specifically to a cylindrical frame unit that allows a predetermined small spacing to be secured particularly between an upper surface of the cylinder bed and an upper inner cylindrical surface of a rotary frame.

BACKGROUND

An embroidery sewing machine is conventionally provided with an X-directional drive mechanism and a Y-directional drive mechanism that transfer a workpiece-holding embroidery frame in two predetermined directions. When sewing various embroidery patterns on a front face of caps or cylindrical fabric such as sleeves of clothing, such embroidery sewing machine is provided with a cap frame unit or a cylindrical frame unit instead of the embroidery frame.

A cylindrical frame unit (cap frame unit) generally has a body frame connected to the Y-directional drive mechanism and a cylindrical rotary frame pivoted rotatably on the body frame. The body frame is driven in the direction parallel to the cylinder bed of the embroidery sewing machine by the Y-directional drive mechanism; whereas the rotary frame is driven by a rotary mechanism connected to the X-direction drive mechanism. The rotary frame allows attachable/detachable attachment of the workpiece-holding cylindrical frame (cap frame).

When mounting the cylindrical frame unit on the embroidery sewing machine, a regulating element is required for supporting the rotary frame on the upper surface side of the cylinder bed of the embroidery sewing machine in order to maintain the rotary frame and the cylindrical frame in their proper positions. It is also desirable for the mounting position of the rotary frame to be vertically adjustable relative to the cylinder bed to absorb differences such as dimensional variance of parts used.

In view of the above requirements, a position regulating mechanism disclosed in JP 2005-76137 A (patent document 1) is provided with a position adjustment element that is supported vertically movably by the body frame. The position adjustment mechanism restricts the rotary frame in its proper position relative to the cylinder bed. More specifically, a protruding wall of the body frame that upwardly protrudes above the rotary frame has a long hole defined for insertion of a fastener bolt. The position adjustment element is fastened to the protruding wall by the fastener bolt inserted in the long hole so as to allow vertical adjustment of its positioning relative to the body frame. When adjusting the position of the rotary frame, the fastener bolt is loosened to lower the position adjustment element relative to the body frame. Thus, a sliding element fixed on the lower end of the position adjustment element applies pressure on the upper surface of the cylinder bed, and the reaction of the pressure regulates the body frame and the rotary frame in its proper upright position.

The cap frame unit disclosed in JP 2005-73813 A (hereinafter referred to as patent document 2) on the other hand, has a position adjustment element closely resembling the counterpart disclosure of patent document 1, and is supported vertically movably by the body frame. Further, a position regulating element abutting the upper surface of the cylinder bed is disposed across a left and right pair of Y-directional connections provided at the rear end of the body frame. The body frame is regulated at a predetermined mount position by the sliding element of the position adjustment element and the position regulating element.

The cap frame units disclosed in patent documents 1 and 2 respectively is mounted on the embroidery sewing machine with the underside of its sliding element placed in abutment with the upper surface of the cylinder bed. In order to allow the rotary frame to rotate smoothly at the upper inner cylindrical surface without contacting the cylinder bed, a small predetermined spacing is required between the upper surface of the cylinder bed and the upper inner cylindrical surface of the rotary frame.

In order to secure such small predetermined spacing, the user was required to hold an integrated assembly of the body frame and the rotary frame on one hand, and insert a thickness gauge of a predetermined thickness between the cylinder bed upper surface and the upper inner cylindrical surface of the rotary frame with the other hand. When a thickness gauge was not available, the user was required to determine the vertical positioning of the rotary frame by visual measurement and fasten the position adjustment element with a bolt, making the positioning of the rotary frame a troublesome task. As described above, obtaining a predetermined small spacing between the cylinder bed upper surface and the upper inner cylindrical surface of the rotary frame is troublesome and complex.

SUMMARY

An object of the present disclosure is to provide a cylindrical frame unit that allows easy vertical adjustment of rotary frame positioning relative to the cylinder bed of the embroidery sewing machine to secure a predetermined small spacing between the cylinder bed upper surface and the upper inner cylindrical surface of the rotary frame without use of tools such as a thickness gauge.

The cylindrical frame unit provided in an embroidery sewing machine including a cylinder bed, an X-directional drive mechanism and a Y-directional drive mechanism, the cylindrical frame unit, including a body frame that is connected to the Y-directional drive mechanism and driven in a direction parallel to the cylinder bed; a cylindrical rotary frame that is pivoted on the body frame and having an inner cylindrical surface;

a cylinder frame that holds a workpiece and being attachably/detachably attached to the rotary frame; a rotary mechanism that is connected to the X-directional drive mechanism and driven perpendicularly to the direction in which the body frame is driven to rotate the rotary frame and the cylinder frame attached thereto; a position regulating element that slidably contacts an upper surface of the cylinder bed and an upper inner cylindrical surface of the rotary frame; and a mount element that secures the position regulating element to the body frame so as to allow adjustment in vertical positioning of the position regulating element relative to the body frame.

When mounting the cylindrical frame unit on the embroidery sewing machine, positioning of the rotary frame can be made by simply securing the position regulating element at a position to slidably contact the upper surface of the cylinder bed and secure the rotary frame at the position where the upper inner cylindrical surface slidably contacts the position regulating element. Since the mount element allows adjustment in vertical positioning of the position regulating element, and adjustment in vertical positioning of the rotary frame relative to the upper surface of the cylinder bed can be made via the position regulating element, the positioning of the rotary frame can be simplified in great extent. Further, a predetermined small spacing can be secured between the inner cylindrical surface of the rotary frame and the upper surface of the cylinder bed without use of tools such as a thickness gauge.

In the present disclosure, the lower surface of the position regulator may be formed into a flat surface; whereas the upper surface of the position regulator may be formed into a partially cylindrical surface parallel to the inner cylindrical surface of the rotary frame. Thus, the partially cylindrical surface of the position regulating element is placed in abutment with the inner cylindrical surface of the rotary frame to maintain the adjusted vertical positioning of the rotary frame by the position regulator.

The curvature radius of the partially cylindrical surface of the position regulator is designed at greater length than the curvature radius of the inner cylindrical surface of the rotary frame. Thus, only left and right ends of the position regulator contact the inner cylindrical surface of the rotary frame. Hence, the area of contact of between the inner cylindrical surface of the rotary frame and the partially cylindrical surface of the position regulator is reduced, consequently reducing the friction coefficient therebetween during rotation of the rotary frame. As a result, the rotary frame can rotated smoothly relative to the body frame. Further, since the rotary frame is supported by the left and right ends of the position regulator upper surface, steady support is provided to the rotary frame.

Further, since the position regulating element of the present disclosure is made of synthetic resin material, frictional coefficient can be reduced while improving tolerance at lower manufacturing costs.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

One exemplary embodiment applying the present disclosure to an embroidery sewing machine, particularly to a multi-needle sewing machine M will be described hereinafter with reference to FIGS. 1 to 9.

Figure 1:
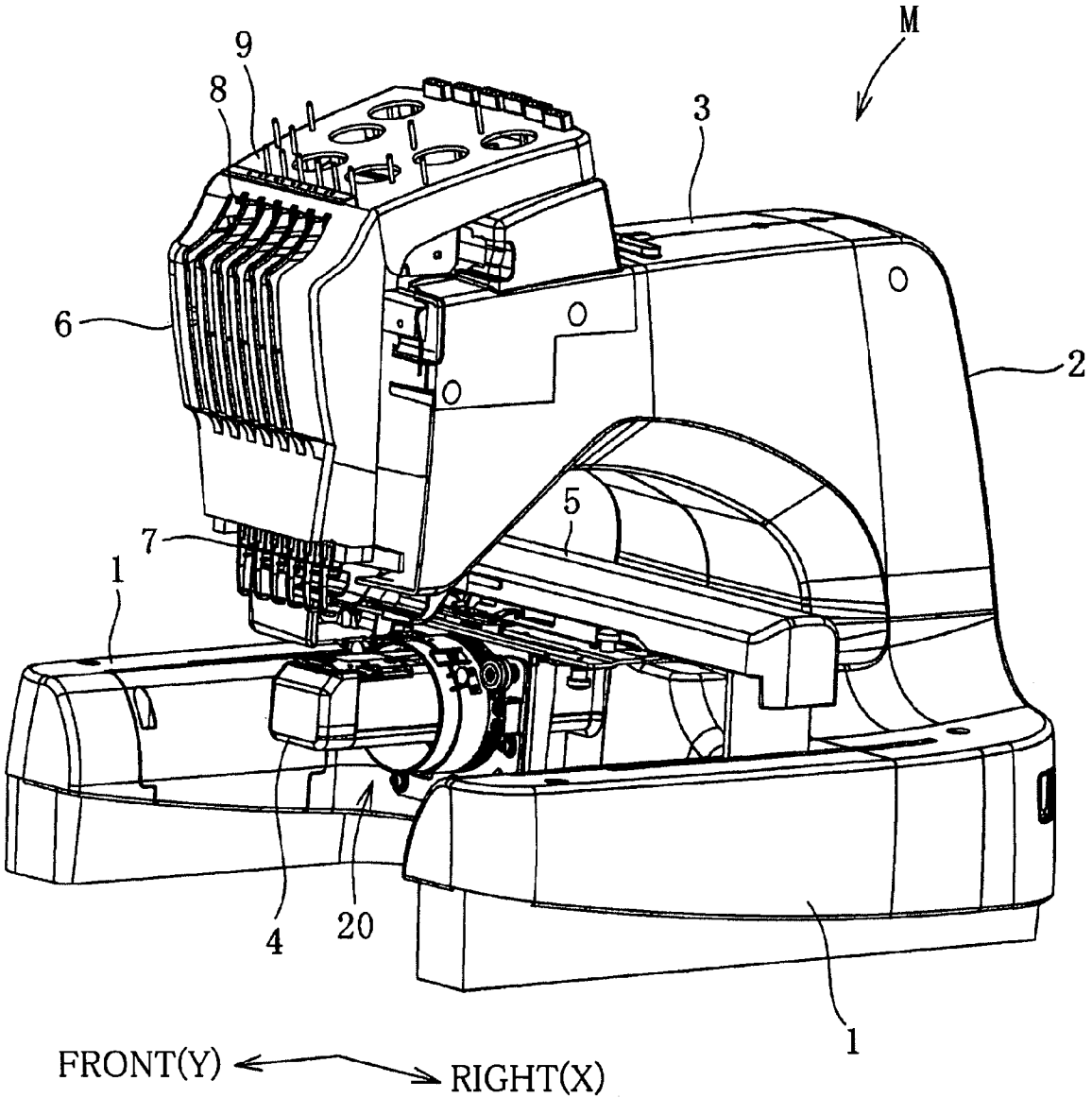
FIG. 1 is a perspective view of a multi-needle sewing machine according to a first exemplary embodiment of the present disclosure.

Referring to FIG. 1, the multi-needle sewing machine M includes feet 1 supporting the entire sewing machine, a pillar 2 standing at the rear ends of the feet 1 (left side indicates the front and the right side indicates the rear in FIG. 1), an arm 3 extending forward from the upper end of the pillar 2, and an angular cylinder bed 4 extending horizontally forward from the lateral center of the feet 1. In the present exemplary embodiment, the longitudinal direction indicative of the extending direction of the cylinder bed 4 represents the Y-direction and the direction perpendicular to the Y-direction and indicative of the laterally extending direction of the later described movable carriage 5 represents the X-direction.

Figure 2:
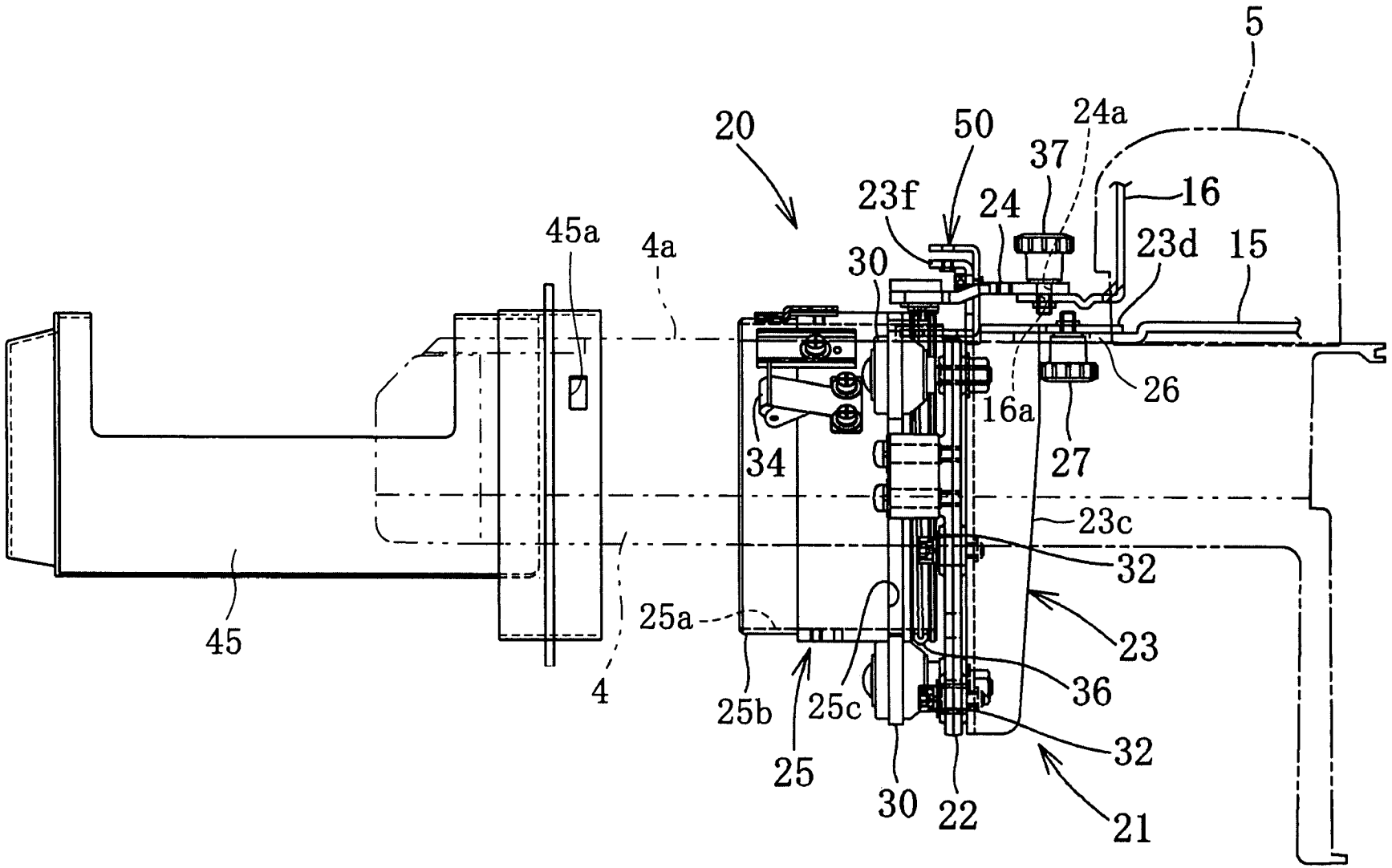
FIG. 2 is a side view of a cylindrical frame unit.

Referring to FIGS. 1 and 2, a movable carriage 5 is provided above the feet 1. The movable carriage 5 contains a carriage frame (not shown) that has a Y-directional feed frame 15 secured to it. Both the left and the right feet 1 contain Y-directional mechanisms (not shown) for moving the movable carriage 5 in its entirety in the Y-direction. Hence, the Y-direction feed frame 15 is moved in the Y-direction along with the movable carriage 5 by the Y-direction drive mechanisms.

The movable carriage 5 contains an X-directional feed frame 16 supported movably in the X-direction by the carriage frame and an X-directional drive mechanism (not shown) for moving the X-directional feed frame 16 in the X-direction. Further, provided in front of the movable carriage is a cylindrical frame unit 20 connected to the X-directional feed frame 16 and the Y-directional feed frame 15.

As shown in FIG. 1, a needle bar case 6 with a synthetic resin cover is attached on the front side of the arm 3. The needle bar case 6 supports six vertically-reciprocable needle bars 7 laterally aligned in a row and six swingable thread take-ups 8, respectively corresponding to each of the needle bars 7, also laterally aligned in a row. Each needle bar 7 has a sewing needle (not shown) attached to its lower end. The needle bar case 6 has secured on its upper end a thread tension frame 9 made of synthetic resin that is slightly upwardly inclined towards the rear. The cylinder bed 4 contains components such as a thread loop taker (not shown) and a thread cutter (not shown) in its front end interior.

Next, a description will be given on the cylindrical frame unit 20.

Figure 3:
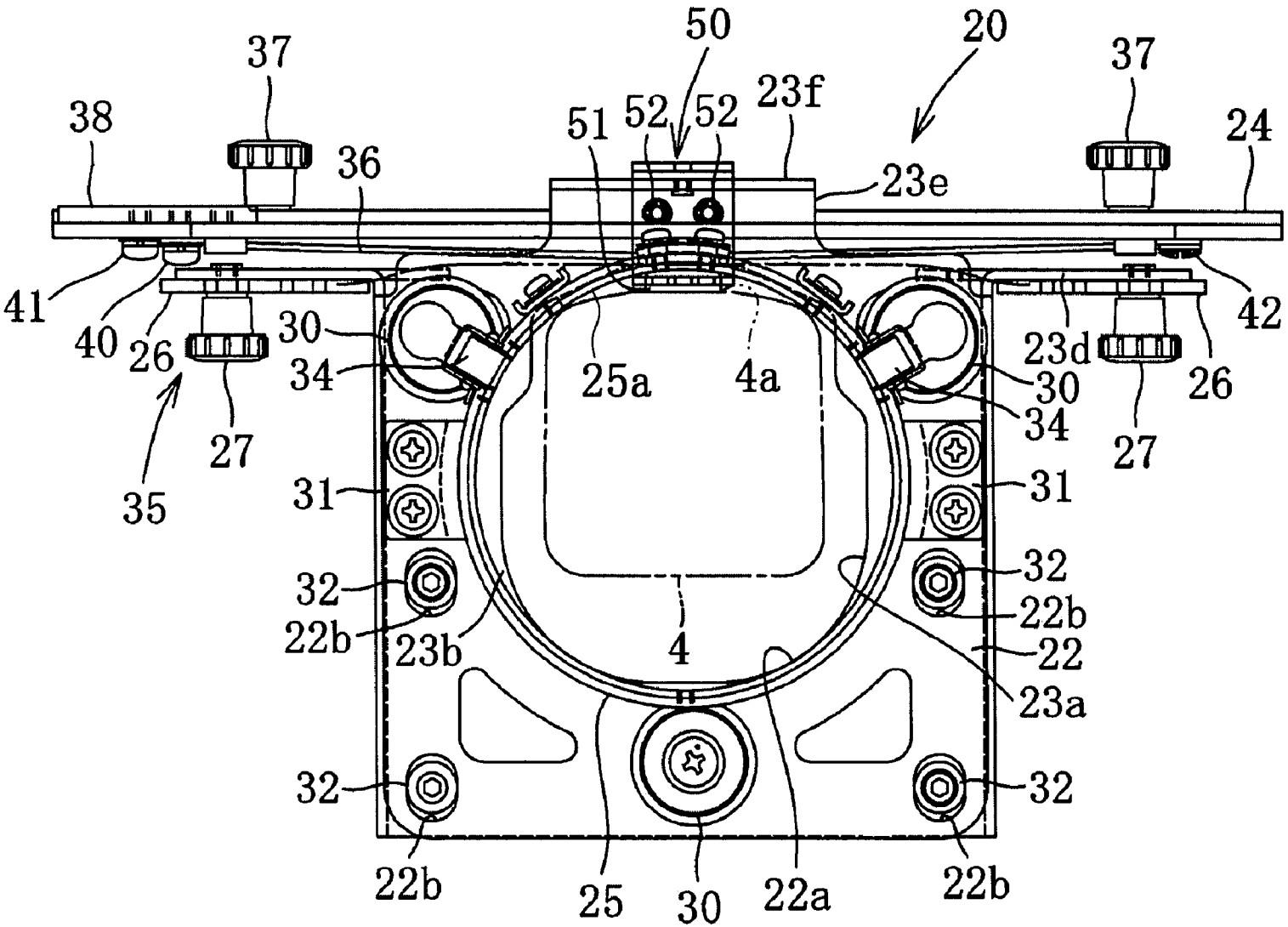
FIG. 3 is front view of the cylindrical frame unit with a cylindrical frame detached.

Referring to FIGS. 1 to 3, the cylindrical frame unit 20 includes a body frame 21 connected to the Y-directional frame 15, a cylindrical rotary frame 25 pivoted on the body frame 21, a rotary mechanism 35 connected to the X-directional frame 16 and that rotates the rotary frame 25, a position regulator 51 that establishes sliding contact with an upper surface 4*a* of the cylinder bed 4 and the upper inner cylindrical surface 25*a* of the rotary frame 25, a mount 50 that allows mounting of the position regulator 50 on the body frame 21, a cylindrical frame 45 attachably/detachably attached to the rotary frame 25. FIG. 2 illustrates the rotary frame 25 before attachment of the cylindrical frame 45.

First, a description will be given on the body frame 21 connected to the Y-directional feed frame 15 and the rotary frame 25 pivoted on the body frame 21.

The body frame 21 includes a connection frame 23 connected to the Y-directional feed frame 15 and a base frame 22 of a predetermined thickness provided in the front side of the connection frame 23.

The base frame 22 has a substantially circular notch 22*a* (refer to FIG. 3) allowing passage of the cylinder bed 4. Three sets of rollers 30 that rotatably support the rotary frame 25 is pivoted on the peripheral edges of the notch 22*a* of the base frame 22. The base frame 22 is further provided with a pair of left and right regulatory blocks 31 for regulating the longitudinal positioning of the rotary frame 25.

The connection frame 23 has a mount wall 23*b* having a notch 23*a* (refer to FIG. 3) defined to allow the cylinder bed 4 to pass through. As shown in FIGS. 2 and 3, the left and right ends of the mount wall 23*b* are bent reward respectively to define bends 23*c*. On the upper end of each bend 23*c*, a pair of left and right Y-directional connections 23*d* are formed that are bent to project horizontally outward (laterally), and the Y-directional connections 23*d* have screw holes 29 (refer to FIG. 7) formed on them. The Y-directional feed frame 15 has a pair of left and right Y-directional connection plates 26 secured to it at positions substantially laterally symmetrical relative to the cylinder bed 4. Each of the Y-directional connection plates 26 has a through hole 26*a* (refer to FIG. 7) defined to it. The body frame 21 is attachably/detachably attached to the Y-directional feed frame 15 by finger bolts 27 passed through the though holes 26*a* and being screwed into the screw holes 29 of the Y-directional connection 23*d*. The body frame 21 thus can be moved in the Y-direction integrally with the Y-directional feed frame 15.

The base frame 22 is secured on the mount wall 23*b* of the connection frame 23 by four fastener bolts 32, for example, so as to be adjustable in height. More specifically, the base frame 22 has vertically-elongate bolt insertion holes 22*b* for insertion of the fastener bolts 32. Thus, when the fastener bolts 32 are loosened, the vertical positioning of the base frame 22 can be adjusted relative to the connection frame 23, in other words, adjustment can be made on the vertical positioning of the rotary frame 25 relative to the connection frame 23.

Referring to FIGS. 2 and 3, the rotary frame 25 is rotatably supported by the body frame 21 via three sets of rollers 30. The rotary frame 25 is made of synthetic resin material and is generally cylindrical. The rotary frame 25 has a cylindrical frame attachment 25*b* formed in its front end for attachable/detachable attachment of the cylindrical frame 45. The outer periphery of the cylindrical frame attachment 25*b* is provided with engagement rollers 34. The engagement rollers 34 establish engagement with engagement holes 45*a* provided on the cylindrical frame 45 when the cylindrical frame 45 is fitted over the front-end side section of the rotary frame 25 to connect the cylindrical frame 45 integrally with the rotary frame 25. Though not described in detail, the cylindrical frame 45 takes a cylindrical shape as illustrated in FIG. 2 and holds cylindrical fabric (not shown) such as sleeves as workpiece.

The rear-end outer periphery of the rotary frame 25 has an annular wire guide groove (not shown) for guidance of a later described wire 36. On the outer peripheral surface of the rotary frame 25 in front of the wire guide groove, an annular roller groove 25*c* is defined for engagement of the 3 sets of rollers 30 and the pair of left and right regulatory blocks 31.

Next, a description will be given on the rotary mechanism 35.

Referring to FIGS. 2 and 3, the rotary mechanism 35 includes a laterally extending movable element 24 connected to the X-directional feed frame 16, wire 36 wound on the wire guide groove of the rotary frame 25 and having both of its ends connected to the two lateral ends of the movable element 24.

The movable element 24 has two through holes 24*a* (refer to FIG. 2) defined at its left and right rear ends; whereas the X-directional feed frame 16 has two screw holes 16*a* (refer to FIG. 2) at positions corresponding to the through holes 24*a*. The through holes 24*a* are located with the screw holes 16*a* when mounting the movable element 24 on the X-directional feed frame 16. Then, finger bolts 37 are inserted into the screw holes 16*a* to secure the movable element 24 to the X-directional feed frame 16. The movable element 24 is connected to the X-directional feed frame 16 in the above described manner.

The movable element 24 has a laterally-repositionable wire connector 38 secured on its left end upper side by a screw 41. At the underside of the movable element 24, one end of the wire 36, leftwardly extending from the rotary frame 25, is connected to the wire connector 38 underside by a screw 40. Similarly the other end of the wire 36, rightwardly extending from the rotary frame 25, is secured to the right end underside of the movable element 24 by a screw 42. The tension of the wire 36 can be adjusted by adjustment of the lateral positioning of wire connector 38 relative to the movable element 24. At the lengthwise mid portion of the wire 36, a globule (not shown) is secured by caulking. The globule is engaged with the engagement hole (not shown) defined on the wire guide groove of the rotary frame 25. Thus, the movement of the wire 36 unslippably wound on the rotary frame 25 causes rotation of the rotary frame 25.

When the X-directional feed frame 16 is laterally moved by the X-directional drive mechanism, the movable element 24 is laterally moved integrally with the X-directional feed frame 16. At this instance, since the ends of the wire 36 connected to the lateral sides of the movable element 24 are also moved, the rotary frame 25 is moved clockwise or counterclockwise in front view. Thus, the rotary mechanism 35 serves as a conveyor that converts lateral motion of the X-directional feed frame 16 into rotary motion of the rotary frame 25.

Referring to FIGS. 2, 3, and 7 to 9, a projection 23*e* extending upward by a predetermined width is formed above the notch 23*a* defined on the mount wall 23*b* of the connection frame 23. On the upper end of the projection 23*e*, a horizontal bend 23*f* is formed that is bent horizontally forward. One the rear-side lateral center of the projection 23*e*, a mount 50 is provided so as to be vertically movable, the mount 50 taking a laterally oriented U-shape in side view. The lower end of the mount 50 is bent forward to define a lower wall 50*c*. The lower wall 50*c* has a position regulator 51 mounted on it, the position regulator 51 resembling a block in shape.

The mount 50 and the position regulator 51 will be detailed hereinafter with reference to FIGS. 4 and 5.

Figure 4:
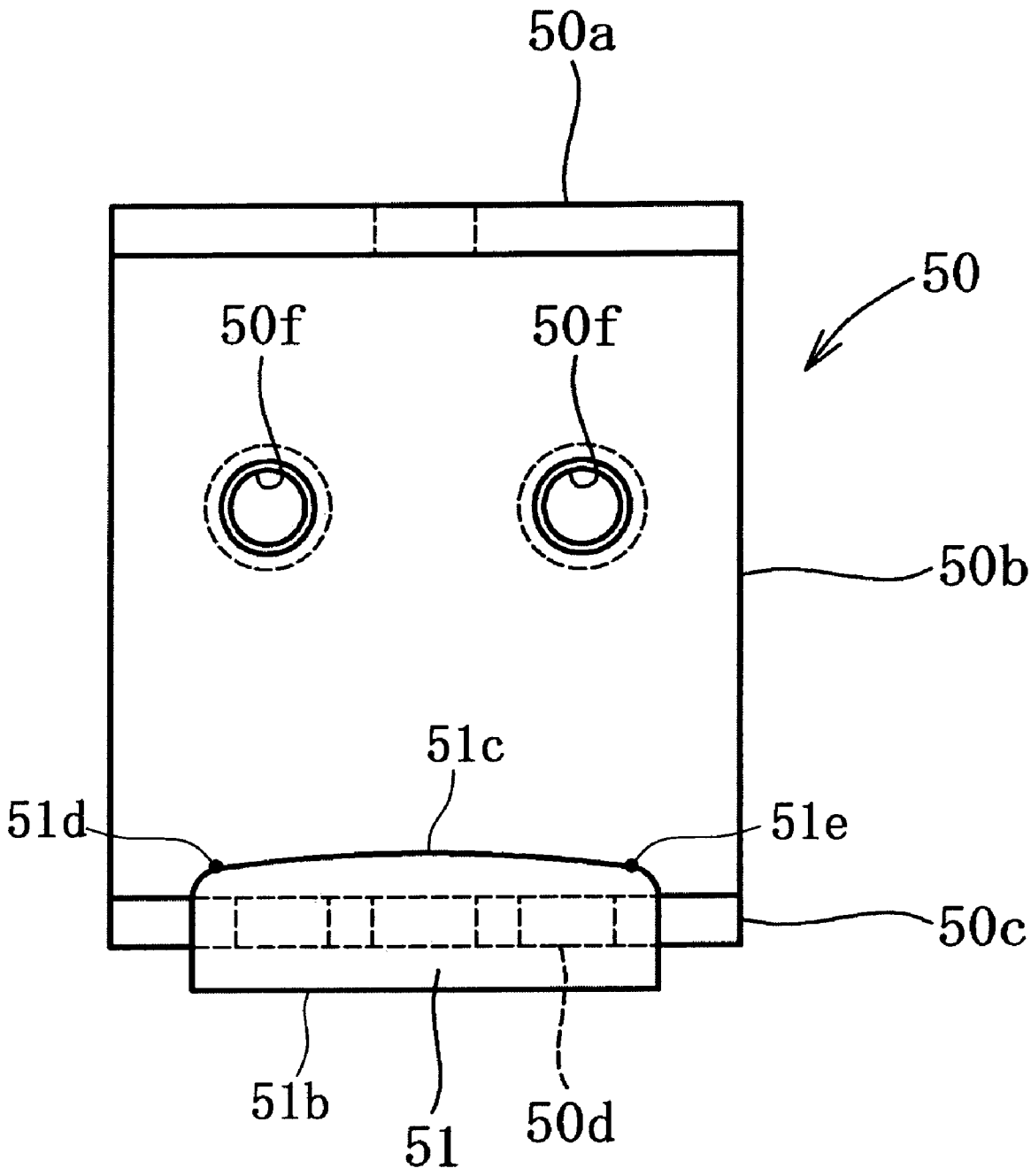
FIG. 4 is a front view of a mount with a position regulator attached.
Figure 5:
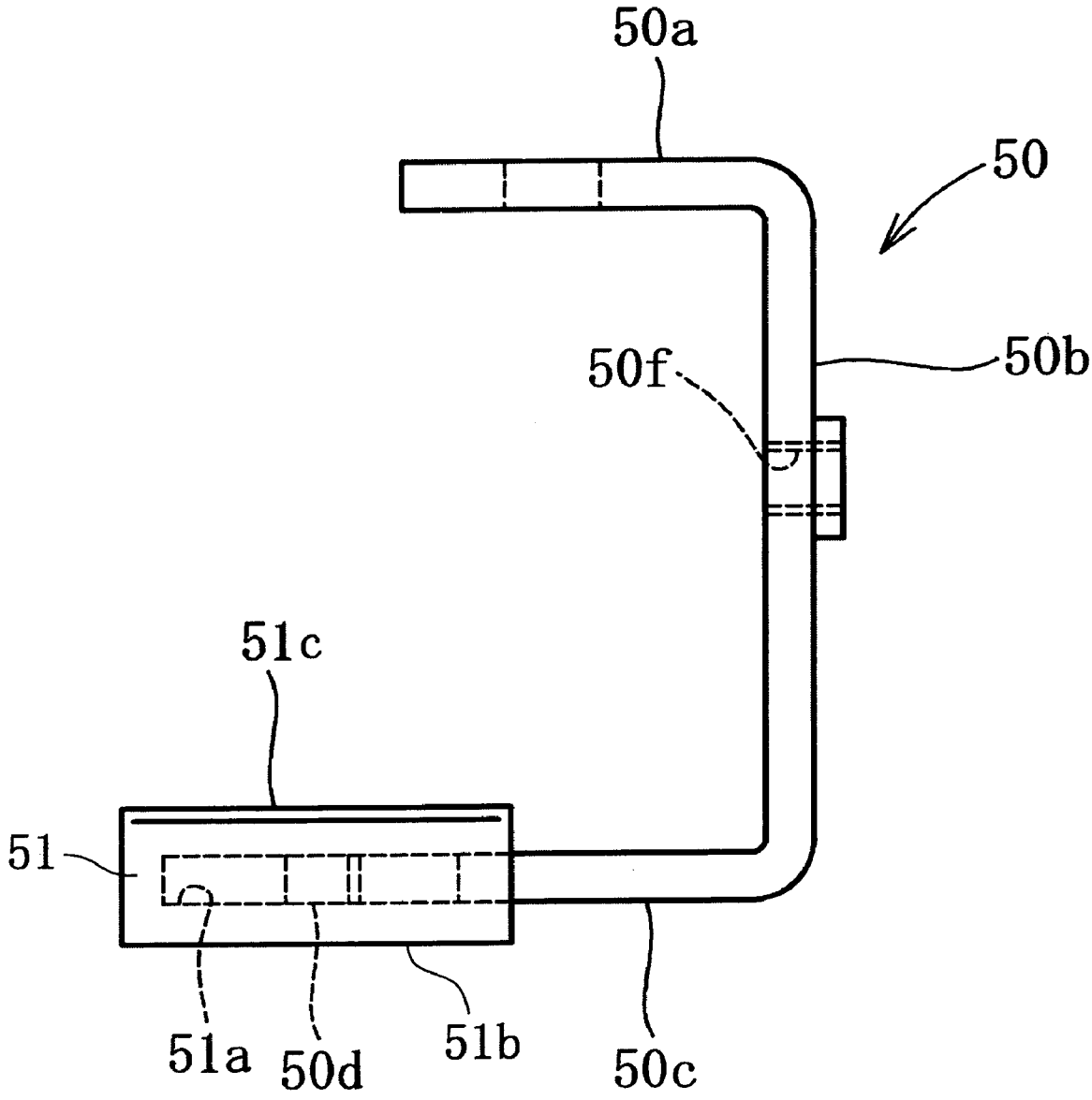
FIG. 5 is a side view of the mount with the position regulator attached.

As shown in FIGS. 4 and 5, the mount 50 is an integral structure comprising an upper wall 50*a*, a connection wall 50*b* and a lower wall 50*c*, taking a laterally oriented U-shape in side view. The upright connection wall 50*b* connecting the upper wall 50*a* and the lower wall 50*c* has left and right bolt holes 50*f* defined on it. The bolt holes 50*f* are finished by succession of burring and tapping process.

Figure 7:
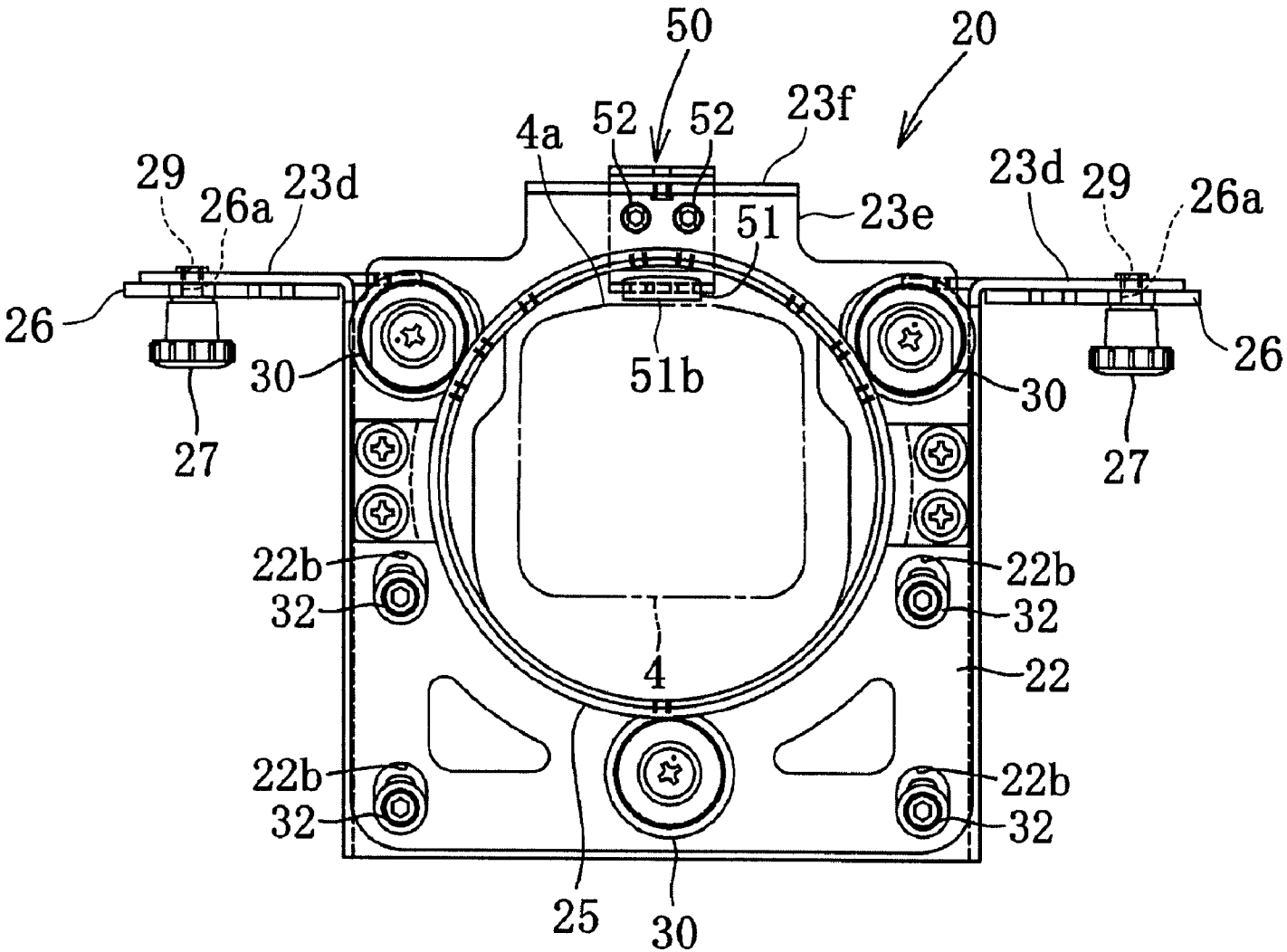
FIG. 7 is a front view of the cylindrical frame unit with the cylindrical frame and a movable element detached.
Figure 8:
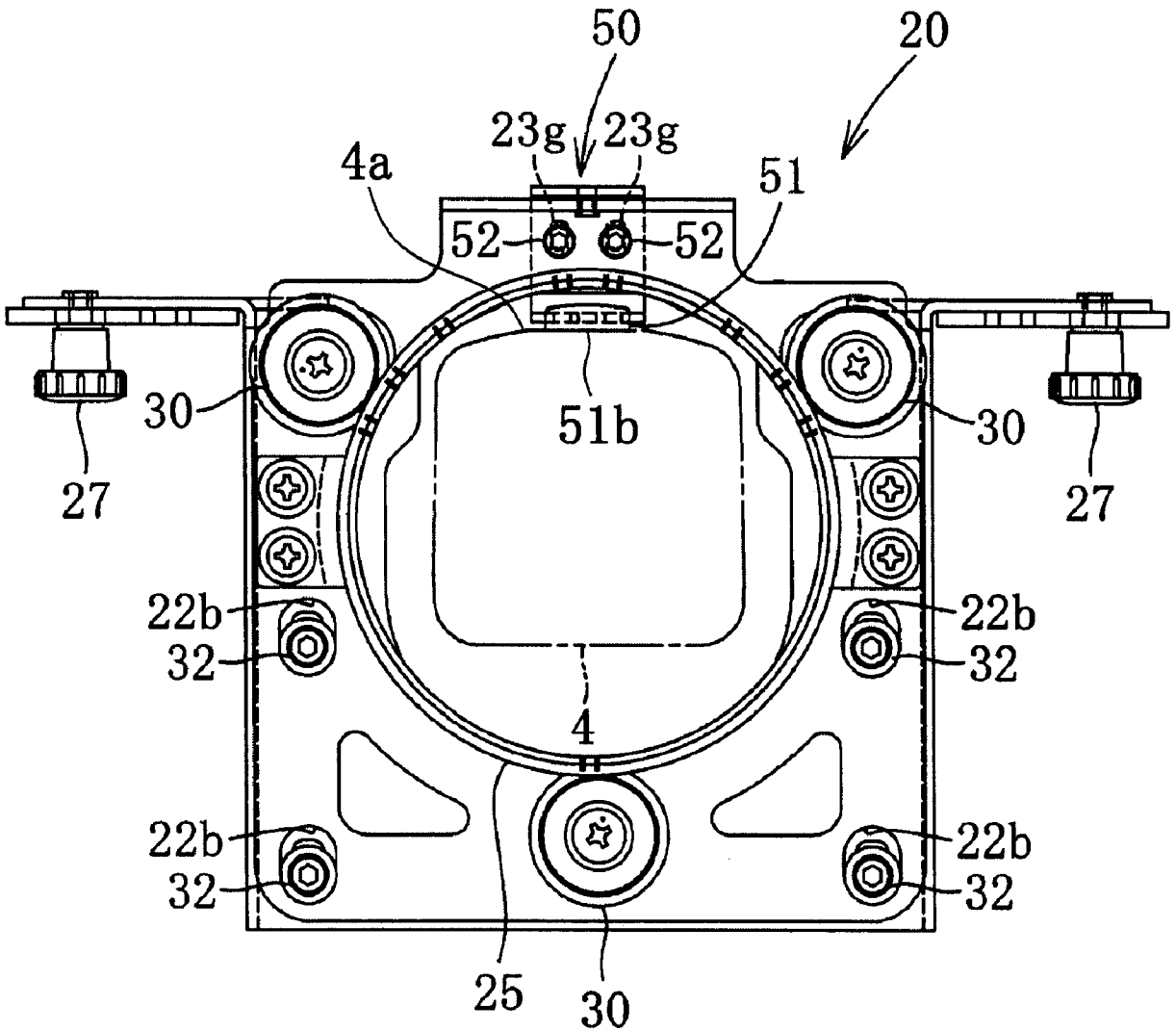
FIG. 8 is a front view of the cylindrical frame unit with the cylindrical frame and the movable element detached and the mount in lowered state.
Figure 9:
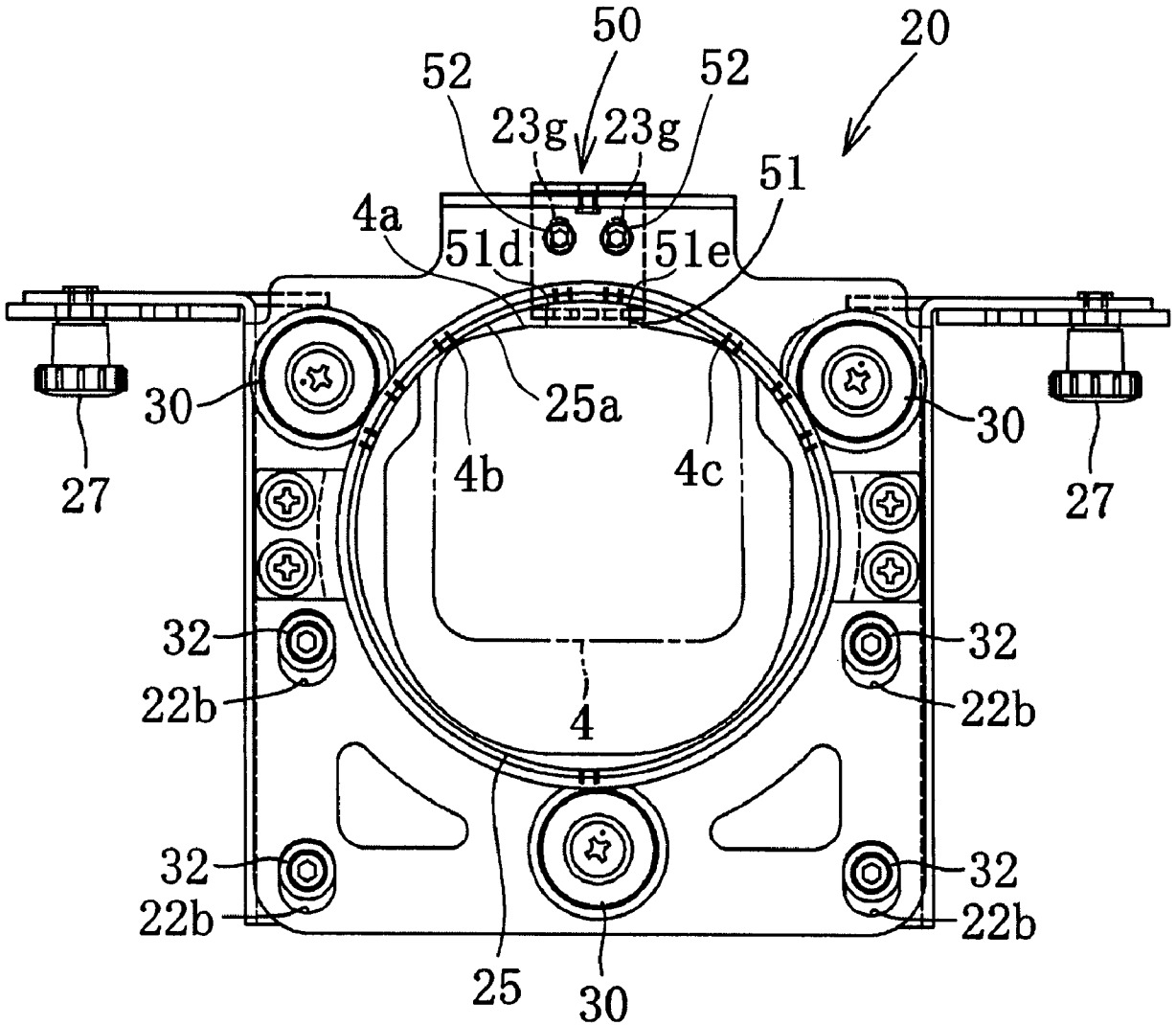
FIG. 9 is a front view of the cylindrical frame unit with the cylindrical frame and the movable element detached and the mount and the rotary frame in lowered state.

Referring to FIGS. 7 to 9, the projection 23*e* of the connection frame 23 has two vertically elongate long holes 23*g* defined at positions corresponding to the two bolt holes 50*f* of the connection wall 50*b* of the mount 50. The fastener bolts 52 inserted into the long holes 23*g* from the front side are screw engaged with the bolt holes 50*f* of the connection wall 50*b* of the mount 50. Thus, the two fastener bolts 52 can be tightened/loosened from the front side of the multi-needle sewing machine M. Further, adjustment can be made on the vertical positioning of the mount 50 relative to the connection frame 23 (body frame 21) via the long holes 23*g* by loosening the fastener bolts 52 from the front side. On the central portion of the lower wall 50*c*, a protrusion 50*d* is formed which is received by a recess 51*a* defined on the position regulator 51. The position regulator 51 is held by receiving the protrusion 50*d* in the recess 51*a*.

The position regulator 51 is made of a wear-resistant synthetic resin material having a low frictional coefficient. Referring to FIGS. 4 and 5, the underside of the position regulator 51 is planarized into a flat surface 51*b* (hereinafter referred to as underside 51*b*); whereas the upper side is formed into a partially cylindrical surface 51*c*. The partially cylindrical surface 51*c* is disposed in parallel relation to an inner cylindrical surface 25*a* of the rotary frame 25. In other words, the partially cylindrical surface 51*c* is formed so that its central axis S1 (refer to FIG. 6) is parallel to the central axis of the central axis S2 (refer to FIG. 6). Curvature radius R1 of the partially cylindrical surface 51*c* of the position regulator 51 is designed to be greater than curvature radius R2 of the inner cylindrical surface 25*a* of the rotary frame 25. Thus, the left and right ends 51*d* and 51*e* of the position regulator 51 upper surface is placed in contact with the inner cylindrical surface 25*a* of the rotary frame 25.

Figure 6:
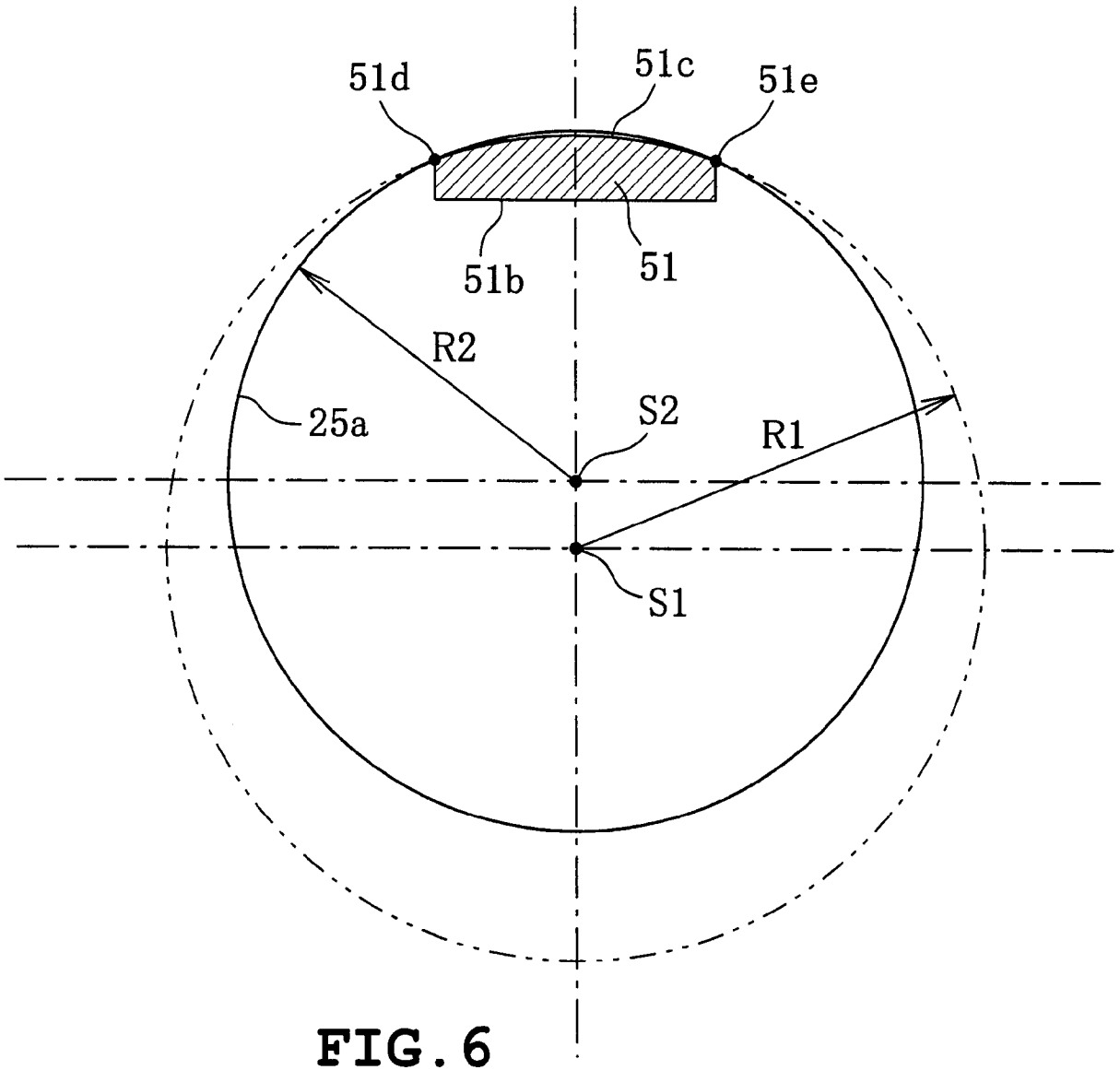
FIG. 6 is a schematic view of the position regulator in abutment with an inner cylindrical surface of a rotary frame.

The above described state will be explained with reference to the schematic illustration provided in FIG. 6. FIG. 6 does not show the R-surface chamfering at corners of the left and right ends of the position regulator 51 upper surface for simplicity. As shown in FIG. 6, curvature radius R1 of the partially cylindrical surface 51*c* of the position regulator 51 is greater than curvature radius R2 of the inner cylindrical surface 25*a* of the rotary frame 25. Thus, the position regulator 51 contacts the inner cylindrical surface 25*a* of the rotary frame 25 at its left and right ends 51*d* and 51*e* and no where else. As described above, the position regulator 51 establishes linear contact with the inner cylindrical surface 25*a* of the rotary frame 25 at two locations, namely the left and right ends 51*d* and 51*e*.

Next, the operation and effect of the cylindrical frame unit 20 will be described with reference to FIGS. 7 to 9.

FIG. 7 shows the position regulator 51 before position adjustment. In this state, the underside 51*b* of the position regulator 51 is spaced apart from the upper surface of the cylinder bed 4.

Then, as shown in FIG. 8, first, the two fastener bolts 52 are loosened to lower the mount 50 relative to the connection frame 23. Then, with the underside 51*b* of the position regulator 51 placed in contact with the upper surface 4*a* of the cylinder bed 4, the two fastener bolts 52 are tightened.

Next, as shown in FIG. 9, the four fastener bolts 32 are loosened to allow the rotary frame 25 to be lowered relative to the connection frame 23. As a result, lowering of the rotary frame 25 is restricted when reaching a position where the inner cylindrical surface 25*a* of the rotary frame 25 abuts the partially cylindrical surface 51*c* of the position regulator 51, more specifically, the position where the upper inner cylindrical surface of the rotary frame 25 contacts the position regulator 51 upper surface at the left and right ends 51*d* and 51*e*. The four fastener bolts 32 are tightened at this position. At this instance, a predetermined small spacing (spacing of 0.5 mm, for example) is created between upper surfaces 4*b* and 4*c* situated at lateral ends continuing from the upper surface 4*a* of the cylinder bed 4 and the upper inner cylindrical surface 25*a* of the rotary frame 25. Thus, the inner cylindrical surface 25*a* of the rotary frame 25 is allowed to rotate smoothly without contacting the cylinder bed 4.

As described above, the multi-needle sewing machine M is provided with the position regulator 51 slidably contacting the upper surface 4*a* of the cylinder bed 4 and the upper inner cylindrical surface 25*a* of the rotary frame 25, and the mount 50 having the position regulator 51 secured thereto and allowing adjustment in vertical positioning of the position regulator 51 relative to the body frame 21. Thus, positioning of the rotary frame 25 can be made by simply securing the position regulator 51 at the position to slidably contact the upper surface 4*a* of the cylinder bed 4 and securing the rotary frame 25 at the position where the upper inner cylindrical surface 25*a* slidably contacts the position regulator 51. Since the mount 50 allows adjustment in vertical positioning of the position regulator 51 and adjustment in vertical positioning of the rotary frame 25 relative to the upper surface 4*a* of the cylinder bed 4 via the position regulator 51, the positioning of the rotary frame 25 can be simplified in great extent. Further, a predetermined small spacing can be secured between the inner cylindrical surface 25*a* of the rotary frame 25 and the upper surface 4*a* of the cylinder bed 4 without use of tools such as a thickness gauge.

The underside of the position regulator 51 is formed into a flat surface 51*b;* whereas the upper side of the position regulator 51 is formed into a partially cylindrical surface 51*c* parallel to the inner cylindrical surface 25*a* of the rotary frame 25. Thus, the partially cylindrical surface 51*c* of the position regulator 51 is placed in abutment with the inner cylindrical surface 25*a* of the rotary frame 25 to maintain the adjusted vertical positioning of the rotary frame 25 by the position regulator 51.

The curvature radius R1 of the partially cylindrical surface 51*c* of the position regulator 51 is designed at greater length than the curvature radius R2 of the inner cylindrical surface 25*a* of the rotary frame 25. Thus, only the left and right ends 51*d* and 51*e* of the position regulator 51 contact the inner cylindrical surface 25*a* of the rotary frame 25. Hence, the area of contact of between the inner cylindrical surface 25*a* of the rotary frame 25 and the partially cylindrical surface 51*c* of the position regulator 51 is reduced, consequently reducing the friction coefficient therebetween during rotation of the rotary frame 25. As a result, the rotary frame 25 can rotated smoothly relative to the body frame 21. Further, since the rotary frame 25 is supported by the left and right ends 51*d* and 51*e* of the position regulator 51 upper surface, steady support is provided to the rotary frame 25.

The position regulator 51 is made of wear-resistant synthetic resin material having low frictional coefficient. Thus, the body frame 21 can be moved smoothly relative to the cylinder bed 4 as well as allowing the rotary frame 25 to be moved smoothly relative to the body frame 21. Furthermore, tolerance of the position regulator 51 can be improved at lower manufacturing costs.

Modifications of the present disclosure will be described partially hereinafter.

The partially cylindrical surface 51*c* of the position regulator 51 being disposed parallel to the inner cylindrical surface 25*a* of the rotary frame 25 may be disposed substantially parallel and not exactly parallel since the longitudinal length of the position regulator 51 is short.

The curvature radius R1 of the partially cylindrical surface 51*c* of the position regulator 51 may be equaled to or smaller in length instead of being greater in length than the curvature radius R2 of the inner cylindrical surface 25*a* of the rotary frame 25. However in such cases, providing support at the two locations, namely the left and right ends 51*d* and 51*e* of the position regulator 51 cannot be expected.

The upper surface of the position regulator 51 may be flat or partially spherical instead of a partially cylindrical surface 51*c*.

The present disclosure may be employed in various types of embroidery sewing machine, without deviation from the scope of the present disclosure.

The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A cylindrical frame unit provided in an embroidery sewing machine including a cylinder bed, an X-directional drive mechanism and a Y-directional drive mechanism, the cylindrical frame unit, comprising:

a body frame that is connected to the Y-directional drive mechanism and driven in a direction parallel to the cylinder bed;

a cylindrical rotary frame that is pivoted on the body frame and having an inner cylindrical surface;

a cylinder frame that holds a workpiece and being attachably/detachably attached to the rotary frame;

a rotary mechanism that is connected to the X-directional drive mechanism and driven perpendicularly to the direction in which the body frame is driven to rotate the rotary frame and the cylinder frame attached thereto;

a position regulating element that slidably contacts an upper surface of the cylinder bed and an upper inner cylindrical surface of the rotary frame; and a mount element that secures the position regulating element to the body frame so as to allow adjustment in vertical positioning of the position regulating element relative to the body frame.

2. The unit, of claim 1, wherein the position regulating element has a flat lower surface and a partially cylindrical upper surface, the partially cylindrical upper surface being parallel to the inner cylindrical surface.

3. The unit, of claim 2, wherein the partially cylindrical surface has a curvature radius greater than a curvature radius of the inner cylindrical surface of the rotary frame.

4. The unit of claim 1, wherein the position regulating element is made of a synthetic resin material.

* * * * *